US009921528B2

(12) United States Patent
Haruta et al.

(10) Patent No.: US 9,921,528 B2
(45) Date of Patent: Mar. 20, 2018

(54) IMAGE FORMING APPARATUS, METHOD TO CONVEY A SHEET, AND COMPUTER READABLE MEDIUM FOR THE IMAGE FORMING APPARATUS

(71) Applicant: BROTHER KOGYO KABUSHIKI KAISHA, Nagoya, Aichi (JP)

(72) Inventors: Kotaro Haruta, Yokkaichi (JP); Takuji Matsuno, Ichinomiya (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 312 days.

(21) Appl. No.: 14/725,501

(22) Filed: May 29, 2015

(65) Prior Publication Data

US 2015/0347885 A1 Dec. 3, 2015

(30) Foreign Application Priority Data

May 30, 2014 (JP) ..... 2014-111899

(51) Int. Cl.
*G03G 15/20* (2006.01)
*G03G 15/23* (2006.01)

(52) U.S. Cl.
CPC ..... *G03G 15/2039* (2013.01); *G03G 15/234* (2013.01); *G03G 2215/2083* (2013.01); *G03G 2215/2087* (2013.01)

(58) Field of Classification Search
CPC ..... G03G 2215/2083; G03G 2215/209; G03G 15/238; G03G 15/235
(Continued)

(56) References Cited

U.S. PATENT DOCUMENTS 7,970,307 B2 * 6/2011 Mabuchi ..... G03G 15/1675 399/66
8,064,816 B2 * 11/2011 Campbell ..... G03G 15/2042 399/389
(Continued)

FOREIGN PATENT DOCUMENTS

JP S638779 A 1/1988
JP 2002-244481 8/2002
(Continued)

OTHER PUBLICATIONS

Notification of Reasons for Rejection dated Feb. 6, 2018 received from the Japanese Patent Office, Application No. 2014-111899, 8 pages.

*Primary Examiner* — Clayton E Laballe
*Assistant Examiner* — Leon W Rhodes, Jr.
(74) *Attorney, Agent, or Firm* — Scully, Scott, Murphy & Presser, P.C.

(57) ABSTRACT

An image forming apparatus including an image forming unit, a fixing unit, a temperature sensor, and a controller to execute a printing operation is provided. The printing operation is conducted at one of a first high-temperature printing pace, a first low-temperature printing pace, a second high-temperature printing pace, and a second low-temperature printing pace depending on a temperature detected by the temperature sensor. The first low-temperature printing pace is one of lower and equal to the first high-temperature printing pace. The second low-temperature printing pace is one of lower and equal to the second high-temperature printing pace. An absolute difference between the second high-temperature printing pace and the second low-temperature printing pace is greater than an absolute difference between the first high-temperature printing pace and the first low-temperature printing pace.

9 Claims, 8 Drawing Sheets

(58) Field of Classification Search
USPC ..... 399/364
See application file for complete search history.

(56) References Cited

U.S. PATENT DOCUMENTS

| | | | | |
|---|---|---|---|---|
| 8,369,757 | B2 * | 2/2013 | Kojima | G03G 15/0131 399/302 |
| 2009/0196637 | A1 * | 8/2009 | Inomata | G03G 15/2042 399/44 |
| 2012/0057893 | A1 | 3/2012 | Sahara | |

FOREIGN PATENT DOCUMENTS

| | | | |
|---|---|---|---|
| JP | 2004212883 | A | 7/2004 |
| JP | 2006-195422 | A | 7/2006 |
| JP | 2009229873 | A | 10/2009 |
| JP | 2012-078787 | | 4/2012 |

* cited by examiner

AXIAL DIRECTION

321

321A

| PRINT SETTING | PRINTING PACE (SHEET INTERVAL) | | |
|---|---|---|---|
| | HIGH TEMPERATURE | LOW TEMPERATURE | DIFFERENCE |
| SINGLE-FACE PRINTING | SHEET INTERVAL 10 | SHEET INTERVAL 12 | 2 |
| DOUBLE-FACE PRINTING (SECOND SIDE) | SHEET INTERVAL 14 | SHEET INTERVAL 14 | 0 |

321B

| PRINT SETTING | PRINTING PACE (SPEED) | | |
|---|---|---|---|
| | HIGH TEMPERATURE | LOW TEMPERATURE | DIFFERENCE |
| REGULAR PAPER | SPEED 10 | SPEED 8 | 2 |
| HEAVY PAPER | SPEED 8 | SPEED 7 | 1 |

FIG. 5

IMAGE FORMING APPARATUS, METHOD TO CONVEY A SHEET, AND COMPUTER READABLE MEDIUM FOR THE IMAGE FORMING APPARATUS

CROSS REFERENCE TO RELATED APPLICATION

This application claims priority from Japanese Patent Application No. 2014-111899 filed on May 30, 2014, the entire subject matter of which is incorporated herein by reference.

BACKGROUND

Technical Field

An aspect of the present disclosure relates to an image forming apparatus for forming an image in an electro-photographic method, a method to convey a sheet in the image forming apparatus, and a computer readable medium to store a computer readable program to control the image forming apparatus.

Related Art

An image forming apparatus for forming an image in an electro-photographic method is known. The image forming apparatus may be equipped with a fixing device to fix a toner image on a sheet by heat. The heat in the fixing device may be absorbed by the sheet as the sheet is conveyed through the fixing device and may not be maintained at a temperature required for fixing the toner image. Therefore, in order to maintain the temperature at a degree required to fix the toner image on the sheet, behaviors of the image forming apparatus may be adjusted in various ways. For example, when a temperature outside the image forming apparatus is lower than a predetermined degree, an interval between one and another sheets to be conveyed through the fixing device may be extended so that a substantial length of time for the fixing device to regain the absorbed heat may be reserved.

SUMMARY

According to the known image forming apparatus mentioned above, however, while the interval between the sheets being conveyed is extended, a quantity of sheets to be processed per unit time may be decreased, and a longer period of time may be required until a user receives the sheets with the images printed thereon.

The present disclosure is advantageous in that an image forming apparatus, by which printing productivity may be restrained from lowering while a temperature required for image-fixing may be maintained, is provided.

According to an aspect of the present disclosure, an image forming apparatus, including an image forming unit configured to form an image on a sheet, a fixing unit configured to thermally fix the image on the sheet, a temperature sensor, and a controller configured to control the image forming unit and the fixing unit to execute a printing operation to print the image on the sheet at one of a plurality of printing paces, is provided. The controller executes the printing operation at a first high-temperature printing pace when a first print setting is applied and when a temperature detected by the temperature sensor is higher than a first threshold value; a first low-temperature printing pace when the first print setting is applied and when the temperature detected by the temperature sensor is one of lower and equal to the first threshold value; a second high-temperature printing pace when a second print setting is applied and when the temperature detected by the temperature sensor is higher than a second threshold value; and a second low-temperature printing pace when the second print setting is applied and when the temperature detected by the temperature sensor is one of lower and equal to the second threshold value. The first low-temperature printing pace is one of lower and equal to the first high-temperature printing pace. The second low-temperature printing pace is one of lower and equal to the second high-temperature printing pace. An absolute difference between the second high-temperature printing pace and the second low-temperature printing pace is greater than an absolute difference between the first high-temperature printing pace and the first low-temperature printing pace.

According to another aspect of the present disclosure, a non-transitory computer readable medium storing computer readable instructions that are executable by a computer to control an image forming apparatus, when executed by the computer, is provided. The image forming apparatus includes an image forming unit configured to form an image on a sheet, a fixing unit configured to thermally fix the image on the sheet, a temperature sensor, and a controller configured to control the image forming unit and the fixing unit to execute a printing operation to print the image on the sheet at one of a plurality of printing paces. The computer readable instructions are configured to cause the computer to control the image forming apparatus by performing the printing operation at a first high-temperature printing pace when a first print setting is applied and when a temperature detected by the temperature sensor is higher than a first threshold value, a first low-temperature printing pace when the first print setting is applied and when the temperature detected by the temperature sensor is one of lower and equal to the first threshold value, a second high-temperature printing pace when a second print setting is applied and when the temperature detected by the temperature sensor is higher than a second threshold value, and a second low-temperature printing pace when the second print setting is applied and when the temperature detected by the temperature sensor is one of lower and equal to the second threshold value. The first low-temperature printing pace is one of lower and equal to the first high-temperature printing pace. The second low-temperature printing pace is one of lower and equal to the second high-temperature printing pace. An absolute difference between the second high-temperature printing pace and the second low-temperature printing pace is greater than an absolute difference between the first high-temperature printing pace and the first low-temperature printing pace.

A method configured be implemented on a processor to control an image forming apparatus is provided. The image forming apparatus includes an image forming unit configured to form an image on a sheet, a fixing unit configured to thermally fix the image on the sheet, a temperature sensor, and a controller configured to control the image forming unit and the fixing unit to execute a printing operation to print the image on the sheet at one of a plurality of printing paces. The method includes controlling the image forming apparatus to perform the printing operation at a first high-temperature printing pace when a first print setting is applied and when a temperature detected by the temperature sensor is higher than a first threshold value, a first low-temperature printing pace when the first print setting is applied and when the temperature detected by the temperature sensor is one of lower and equal to the first threshold value, a second high-temperature printing pace when a second print setting is applied and when the temperature detected by the temperature sensor is higher than a second threshold value, and a second low-temperature printing pace when the second print setting is applied and when the temperature detected by the temperature sensor is one of lower and equal to the second threshold value. The first low-temperature printing pace is one of lower and equal to the first high-temperature printing pace. The second low-temperature printing pace is one of lower and equal to the second high-temperature printing pace. An absolute difference between the second high-temperature printing pace and the second low-temperature printing pace is greater than an absolute difference between the first high-temperature printing pace and the first low-temperature printing pace.

BRIEF DESCRIPTION OF THE ACCOMPANYING DRAWINGS

FIG. 5 is a printing pace table to be used in the printer according to the embodiment of the present disclosure.

DETAILED DESCRIPTION

Hereinafter, an exemplary configuration of a printer 100 according to an embodiment of the present disclosure will be described with reference to the accompanying drawings. The printer 100 is a multicolor printer equipped with a function to form a colored image in an electro-photographic method and is capable of printing images on either side or both sides of a sheet.

Figure 1:
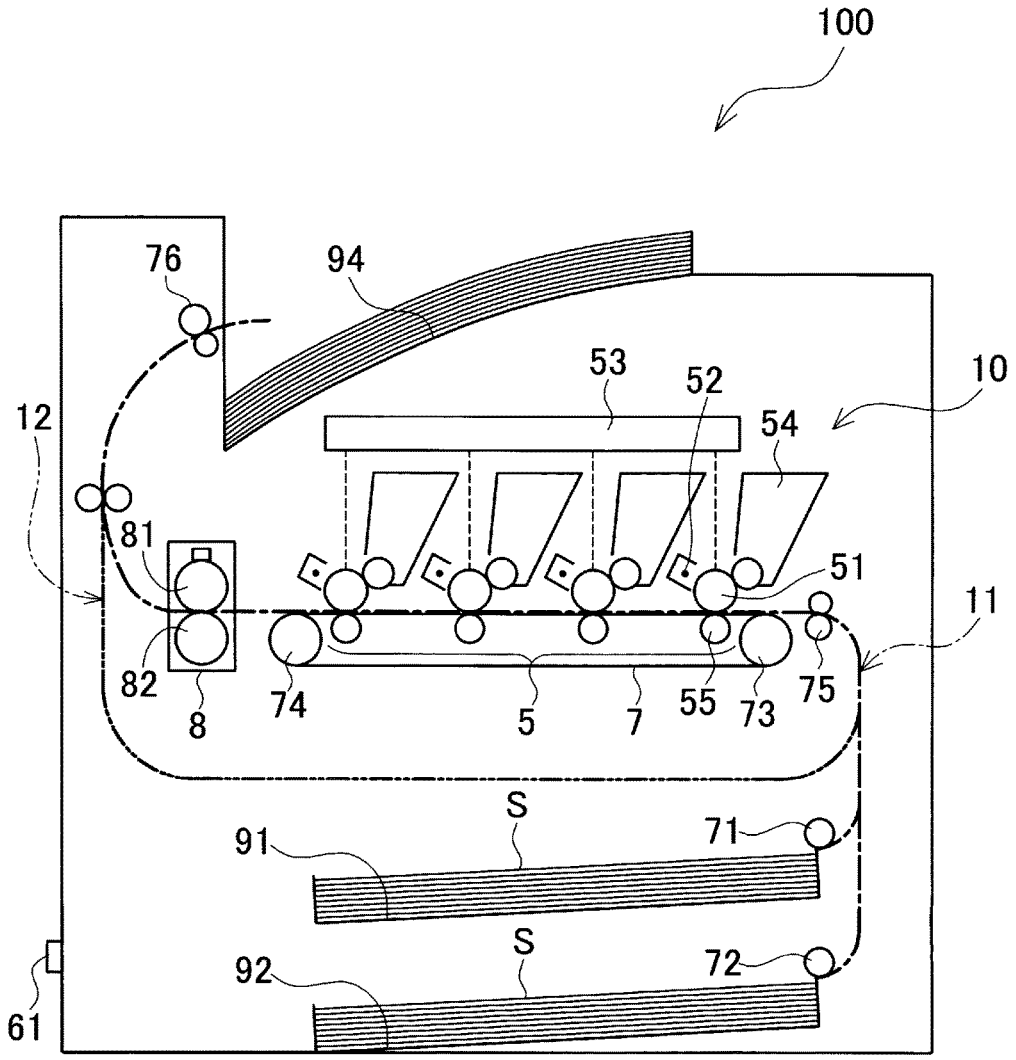
FIG. 1 is an illustrative cross-sectional view of a printer according to an embodiment of the present disclosure.

The printer 100 includes, as shown in FIG. 1, an image forming unit 10 for printing an image on a sheet S. The image forming unit 10 includes a processing unit 5, a conveyer unit 7, and a fixing unit 8. The processing unit 5 is configured to form a toner image on the sheet S in the electro-photographic method. The conveyer belt 7 is configured to convey the sheet S to the processing unit 5, and the fixing unit 8 is configured to fix the toner image on the sheet S. The processing unit 5 includes smaller units, which are arranged to align along the conveyer belt 7 to form toner images in four (4) colors, e.g., yellow, magenta, cyan, and black.

More specifically, the processing unit 5 includes a photosensitive member 51, a charger 52, a developer unit 54, and a transfer unit 55 for each of the four colors; and further includes an exposure unit 53, which is disposed in an upper position with respect to these members. When an image is printed, the printer 100 controls the chargers 52 to electrically charge surfaces of the photosensitive members 51 evenly and the exposure unit 53 to expose the surfaces of the photosensitive members 51 selectively to light. Thereby, electrostatic latent images are formed on the surfaces of the photosensitive members 51. Thereafter, the printer 100 controls the developer unit 51 to supply colored toners to the electrostatic latent images on the surfaces of the photosensitive members 51 so that the latent images are developed to be toner images on the photosensitive members 51.

The printer 100 further includes a feeder tray 91 to store the sheets S to be used in a printing operation and an outlet tray 94, on which the sheets S with the printed images are stacked. The printer 100 includes the conveyer belt 7, feed rollers 71, 72, a registration roller pair 75, and an outlet roller 76 to convey the sheets S. The sheets S are conveyed by these conveying members through conveyer paths, which include a conveyer path 11 and a conveyer path 12.

The conveyer path 11 is a pathway for the sheet S to be conveyed from one of the feeder trays 91, 92 to the outlet tray 94 through the processing unit 5 and the fixing unit 8. The conveyer path 12 diverges from the conveyer path 11 at a downstream position from the fixing unit 8 and merges with the conveyer path 11 at an upstream position from the registration roller pair 75 with regard to a conveying direction to convey the sheet S. In FIG. 1, the conveyer path 11 is indicated by a dash-and-dot line, and the conveyer path 12 is indicated by a dash-and-double-dot line.

The conveyer belt 7 is rolled along with rotation of belt rollers 73, 74 to convey the sheet S from the processing unit 5 to the fixing unit 8. The feed roller 71 is rotated to convey the sheet S stored in the feeder tray 91 to the conveyer path 11, and the feed roller 72 is rotated to convey the sheet S stored in the feeder tray 92 to the conveyer path 11. The registration roller pair 75 is a pair of rollers, which are controlled to be rotated and stopped. The printer 100 may control timings to convey the sheet S to the conveyer belt 7 by controlling the rotation of the registration roller pair 75. The outlet roller 76 is rotated to eject the sheet S with the printed image to the outlet tray 94.

When the image is to be printed on the sheet S, the sheet S is conveyed along the conveyer path 11 to the image forming unit 10, where the image is formed on the sheet S. In particular, in the image forming unit 10, the toner image is formed and transferred onto the sheet S in the processing unit 5, and the transferred toner image is fixed on the sheet S in the fixing unit 8. If the image is to be printed solely on one side of the sheet S under a print setting of single-face printing, the sheet S with the image printed on the single side is ejected to the outlet tray 94.

Meanwhile, if the images are to be printed on both sides of the sheet S under a print setting of double-face printing, the sheet S with the image printed on one side thereof is conveyed again to the image forming unit 10 through the conveyer path 12 without being ejected. In particular, the above-mentioned rollers in the printer 100 are controlled so that the sheet S passed through the fixing unit 8 is halted before being ejected, the direction to convey the sheet S is reversed, and the sheet S is conveyed again to the processing unit 5 in the image forming unit 10. In the image forming unit 10, the image is printed on the reverse side of the sheet S, and the sheet S with the images printed on the both sides is ejected in the outlet tray 94.

The printer 100 according to the present embodiment is equipped with an exterior thermistor 61 (see FIG. 1), which is disposed on an exterior surface of the printer 100, to measure a temperature of exterior ambience of the printer 100. The exterior thermistor 61 is located in a position, where the exterior thermistor 61 may be less likely to be affected by an interior temperature inside the printer 100. There, the exterior thermistor 61 outputs different signals depending on temperatures in the ambience surrounding the exterior thermistor 61, and the printer 100 estimates the exterior temperature based on the output signals from the exterior thermistor 61. Meanwhile, in the printer 100, a temperature in the sheet S having been stored in the feeder tray 91 or the feeder tray 92 may tend to be substantially similar or close to the exterior temperature.

Next, the fixing unit 8 in the printer 100 will be described with reference to FIG. 2. The fixing unit 8 includes a heat roller 81, a pressure roller 82, and a heater 83. The heat roller 81 is a cylindrical member having a higher heat-conductivity and is rotatably arranged in the fixing unit 8. The pressure roller 82 includes a core (not shown) and a resilient layer (not shown) fitted around the core. The pressure roller 82 is urged against the heat roller 81 with a certain amount of pressure so that the resilient layer may be deformed by the pressure to some extent, and thus the pressure roller 82 provides fixing nip, by which the sheet S is pressed and heated, together with the heat roller 81. The heater 83 may be, for example, a halogen lamp, and is disposed inside the heat roller 81.

The heat roller 81 is heated by the heater 83 while the image on the sheet S is fixed in the fixing unit 8. Meanwhile, the pressure roller 82 being urged against the heat roller 81 is rotated. The sheet S is heated and pressed at the nip between the pressure roller 82 and the heat roller 81, as shown in FIG. 2. In this regard, the heat roller 81 is rotated along with the pressure roller 82 and the sheet S.

Figure 2:
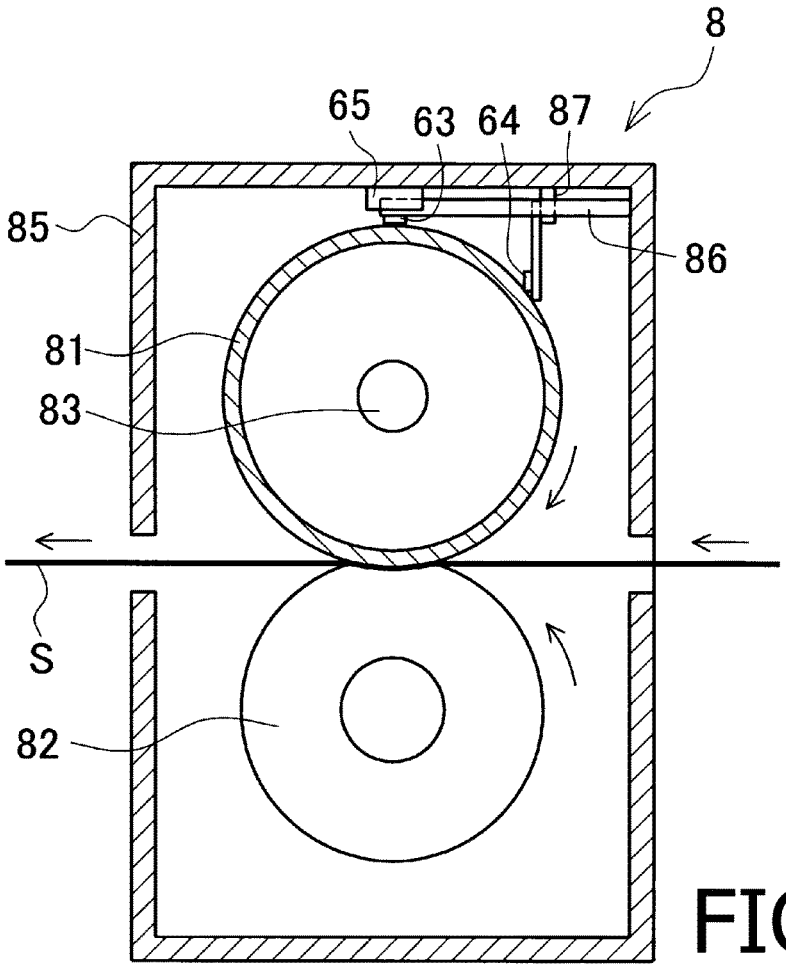
FIG. 2 is a cross-sectional view of a fixing unit in the printer, viewed along an axial direction of the fixing unit, according to the embodiment of the present disclosure.

The fixing unit 8 further includes, as shown in FIG. 2, a box-shaped frame 85 to contain the heat roller 81 and the pressure roller 82, and a plurality of temperature detectors, which are attached inside the frame 85. The plurality of temperature detectors include a central thermistor 63, a side thermistor 64, and a thermostat 65, which are arranged to detect temperatures in detectable areas. The central thermistor 63 may detect a temperature at a central area of the heat roller 81 along an axial direction of the heat roller 81. The side thermistor 64 may detect an axial-end area of the heat roller 81. The detectable areas may include an outer circumference of the heat roller 81 and areas surrounding the heat roller 81. In FIG. 2, the central thermistor 63, the side thermistor 64, and the thermostat 65 are shown in positions apart from the nip between the pressure roller 83 and the heat roller 81; however, the plurality of temperature detectors may be arranged elsewhere in the fixing unit 8 as long as the plurality of temperature detectors are aimed to detect the temperatures in detectable areas on the heat roller 81 other than a pathway range for the sheet S.

The central thermistor 63 and the side thermistor 64 are each configured to output different signals depending on the temperature at the respective detectable areas. As shown in FIG. 2, the central thermistor 63 is supported by a support bar 86, which is attached to the frame 85, to be in proximity to, but not to be in contact with, the heat roller 81. On the other hand, the side thermistor 64 is supported by a support bar 87, which is attached to the frame 85, to be in contact with the outer circumference of the heat roller 81.

The thermostat 65 is configured to supply or shut off electricity to the heater 83 so that the temperature in the outer circumference of the heat roller 81 should be maintained in a predetermined temperature range. For example, when a temperature detected by the thermostat 65 is higher than a predetermined shutoff temperature, the electricity to the heater 83 is shut off. The thermostat 65 is arranged not to contact the heat roller 81.

As mentioned above, neither the central thermistor 63 nor the thermostat 65 is in contact with the circumferential surface of the heat roller 81; therefore, there is no harm that the circumferential surface of the heat roller 81 might be damaged by the central thermistor 63 or the thermostat 65. Meanwhile, the side thermistor 64 is placed to contact the heat roller 81, at a position outside the pathway range for the sheet S to pass through. Therefore, there may be a concern that the heat roller 81 might be damaged by the side thermistor 64, but only in the position outside the pathway range for the sheet S. In other words, even if the circumferential surface of the heat roller 81 may be damaged by the contact with the side thermistor 64, an image-fixing quality of the fixing unit 8 should not be affected by the damage, which is made outside the pathway range for the sheet S.

Meanwhile, there is a preferable fixing range in the fixing unit 8, wherein the image may be fixed securely on the sheet S, due to a limitation of a length of the fixing unit 8 along the axial direction of the heat roller 81. That is, depending on a dimension of the fixing unit 8 along the axial direction, a size of the sheet S usable in the printer 100 with regard to a direction orthogonal to the conveying direction may be limited. In this regard, according to the present embodiment, a maximum usable size Wmax and a minimum usable size Wmin for the sheet S, which may be preferably usable in the printer 100, are setup in advance (see FIG. 3). When the size of the sheet S is smaller than the maximum usable size Wmax, the sheet S may be conveyed in a central area with regard to the axial direction of the fixing unit 8.

Figure 3:
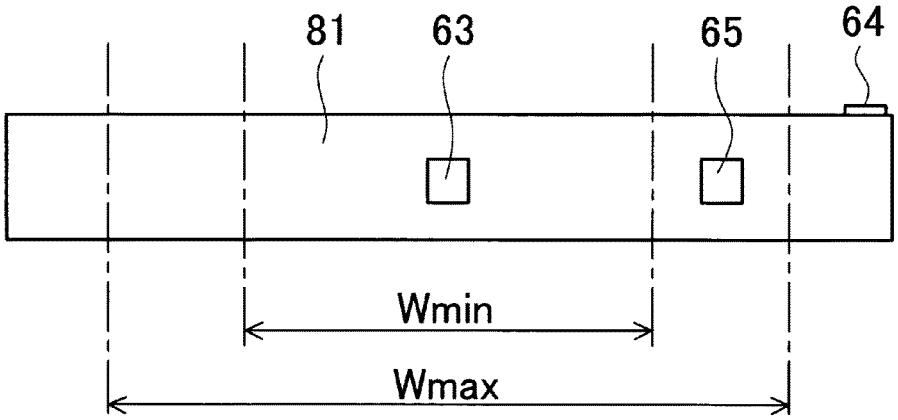
FIG. 3 is a schematic view of an arrangement of the fixing unit and sensors, viewed along a direction orthogonal to the axial direction of the fixing unit, according to the embodiment of the present disclosure.

Meanwhile, the central thermistor 63 is, as shown in FIG. 3, disposed in a central area with regard to the axial direction of the heat roller 81. Therefore, as long as a width of the sheet S is in a usable range in the printer 100, with regard to the axial direction of the heat roller 81, the sheet S should pass through the detectable area of the central thermistor 63.

On the other hand, the side thermistor 64 is disposed on an axial end of the heat roller 81, which is outside the fixing range of the fixing unit 8 and inside a non-pathway range, where the sheet being conveyed does not fall onto. In other words, with regard to the axial direction of the heat roller 81, the sheet S with the usable width does not pass through the detectable area for the side thermistor 64.

Figure 4:
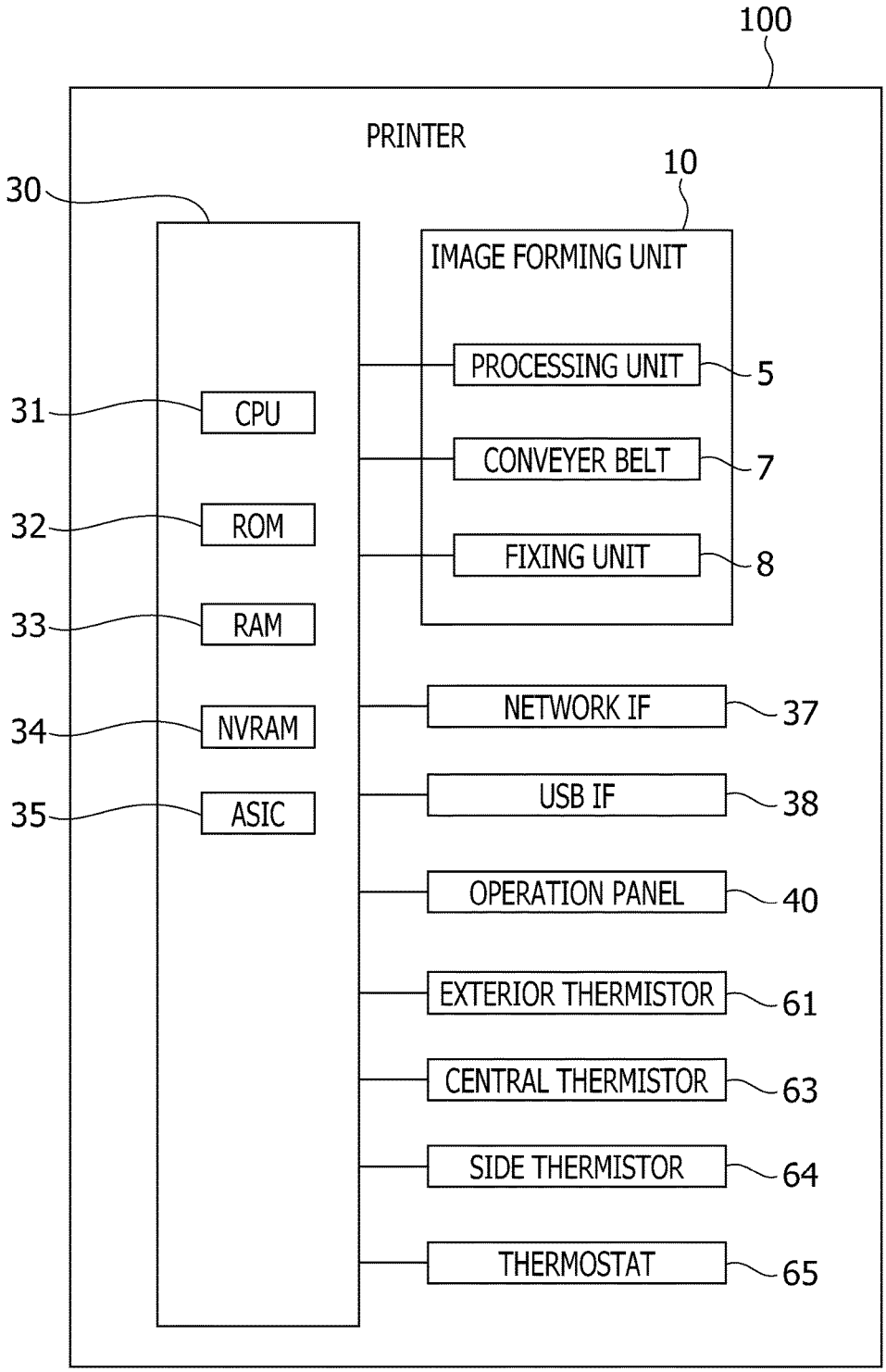
FIG. 4 is a block diagram to illustrate a configuration of a controller and related components in the printer according to the embodiment of the present disclosure.

Next, an electrical configuration of the printer 100 will be described with reference to FIG. 4. The printer 100 includes a controller 30, which is a computing device including a central processing unit (CPU) 31, a read-only memory (ROM) 32, a random access memory (RAM) 34, a non-volatile RAM (NVRAM) 34, and an application specific integrated circuit (ASIC) 35. The printer 100 further includes the image forming unit 10, an operation panel 40, a network interface (IF) 37, and a USB IF 38, which are electrically connected with the controller 30.

The image forming unit 10 includes the processing unit 5, the conveyer belt 7, and the fixing unit 8, which have been mentioned above. Further, the printer 100 includes the exterior thermistor 61, the central thermistor 63, the side thermistor 64, and the thermostat 65, which are electrically connected with the controller 30.

The ROM 32 stores various kinds of controlling programs, setting values, and information to control the printer 100. The RAM 33 is used as a work area, in which the controlling programs are run, and a memory area, in which temporal data is stored. The CPU 31 reads the controlling programs from the ROM 32 and stores results of computation obtained through the controlling programs in the RAM 33 and the NVRAM 34 to control the components in the printer 100.

In the present embodiment, the printer 10 is provided with the controller 30 including the single CPU 31, the ROM 32, the RAM 33, the NVRAM 34, and the ASIC 35. However, for example, the controller 30 may be equipped with a plurality of CPUs 31. For another example, the controller 30 may be a combination of the CPU 31 and a hardware circuit such as the ASIC 35. Further, the controller 30 may be configured with a hardware circuit alone. In other words, the controller 30 may not necessarily be one or only hardware device to control the printer 100.

The network IF 37 is a hardware device, which enables communication between the printer 100 and another device connected with a network through, for example, a LAN cable. The USB IF 38 is a hardware device, which enables communication between the printer 100 and another device connected with the printer 100 through, for example, a USB cable.

The operation panel 40 is arranged on an exterior face of the printer 100. The operation panel 40 includes a liquid crystal display and buttons (not shown), which include a start-key, a stop-key, and numerical keys.

The exterior thermistor 61, the central thermistor 63, and the side thermistor 64 are sensors, which output different signals depending on temperatures at the respective detectable areas. The thermostat 65 is a breaker switch, which shuts off the electricity at a predetermined shutoff temperature.

Next, the printing operation to be performed in the printer 100 will be described below. The printer 100 is configured to operate under a plurality of print settings and determines the print settings to be applied to the printing operation based on a print command, which may be entered by a user. The print settings may vary depending on the contents of the print command and may include, for example, single/double-face printing, and a type of the sheet S to be used.

Some of the print settings may be associated with printing paces. A printing pace is an indication of efficiency (printing speed) in a printing operation, which is performed between a start point, at which a printing action to print an image on a side of the sheet S starts, and a completion point, at which image-fixing of the printed image on the side of the sheet S ends. The printing pace may be indicated by a quantity of sheets being processed in the printer 100 per unit of time. The printing paces may be changed by, for example, altering an interval between two (2) sheets S to convey, or by altering a conveying speed to convey the sheets S.

According to the present embodiment, a printing pace for a low-temperature ambience and a printing pace for a high-temperature ambience are prepared for the printer 100. In this regard, the high-temperature ambience may refer to an ambience other than the low-temperature ambience and may include an ambience in a temperature range of ordinary room temperatures. The low-temperature ambience may be an ambience in a temperature, which is lower than or equal to a predetermined degree of temperature. The high-temperature ambience may be in a temperature, for example, higher than 14 degrees C., and the low-temperature ambience may be in a temperature lower than or equal to 14 degrees C. In the following description, the printing pace for the high-temperature ambience may be referred to as a high-temperature printing pace, while the printing pace for the low-temperature ambience may be referred to as a low-temperature printing pace.

In the low-temperature ambience, a temperature of an unused sheet S may be lower, compared to a temperature of an unused sheet S in the high-temperature ambience; therefore, it may be likely that a greater amount of the heat is absorbed from the heat roller 81 by the sheet S as the image is fixed on the sheet S. Accordingly, in the low-temperature ambience, it may be likely that a longer time is required than the high-temperature ambience for the heat roller 81 to recover to a fixing temperature which is warm enough for a next sheet S. In this regard, in the printer 100 according to the present embodiment, the low-temperature printing pace for the low-temperature ambience is lower than or equal to the high-temperature printing pace for the high-temperature ambience. Thus, the image may be fixed steadily on the sheet S even in the low-temperature ambience.

In the printer 100 according to the present embodiment, each print setting is associated with either the high-temperature printing pace or the low-temperature printing pace, and as shown in FIG. 5, a printing pace table 321 indicating the association between each print setting and the printing pace is stored in the ROM 32. When the printer 100 receives a print command entered by the user, the printer 100 obtains the ambient temperature and the print setting designated in the print command. Further, the printer 100 refers to the printing pace table 321 and determines a printing pace associated with the designated print setting and the ambient temperature. Based on the determined printing pace, the printer 100 manipulates the registration roller pair 75 and the conveyer belt 7 to convey the sheet S and conducts the printing operation.

The printing pace table 321 may include, for example, as shown in FIG. 5, a sheet-interval table 321A, which indicates the printing paces on basis of an interval (distance) between the sheets S, and a speed table 321B, which indicates the printing paces on basis of a conveying speed to convey the sheets S. The printer 100 may obtain one of the printing paces to be applied in the printing operation from at least one of the sheet-interval table 321A and the speed table 321B depending on the print setting.

The sheet-interval table 321A indicates the printing paces associated with the print settings of single-face printing and double-face printing. For example, the sheet-interval table 321A may indicate relative ratio of the printing paces, while the printing pace in the high-temperature ambience for double-face printing may be expressed as "interval 10." In this regard, a larger value of the interval may express a longer distance to be reserved between the two sequentially conveyed sheets; therefore, the printing pace (efficiency) may be lower. Meanwhile, the speed table 321B indicates conveying speeds associated with regular printing paper and heavy paper. The heavy paper may have a thickness which is greater than the regular printing paper. For example, the speed table 321B may indicate relative ratio of the printing paces, while the printing pace in the high-temperature ambience for the regular paper may be expressed as "speed 10." In this regard, a smaller value of the speed may express a slower conveying speed; therefore, the printing pace (efficiency) may be lower. The printing pace may not necessarily be expressed in relative ratio, but may be expressed in absolute numerical values indicating the intervals and the conveying speeds, or may be expressed by indexes that may sum up these conditions.

As shown in FIG. 5, the printing paces may differ depending on the print settings. For example, double-face printing, in which images are printed on both sides of a sheet S, may be conducted in a slower printing pace than single-face printing for two (2) sequential sheets S, in which images are printed on one side of a sheet S and on one side of another sheet S sequentially, even when the sheets S are all in a same size. More specifically, when images for two (2) pages are printed on both (first and second) sides of a single sheet, a longer time may be required than a printing period required for printing images on one (first) side of each of two (2) sheets.

This is because double-face printing with one sheet S may take longer time than single-face printing with two sheets S in a reason that, when the images are printed on both sides of the single sheet S, in order to have the image printed on the second side, the sheet S with the image printed on the first side is conveyed through the conveyer path 12. In other words, the longer time may be caused by the conveyance of the sheet S through the conveyer path 12. Further, during double-face printing, in order to avoid collision between two sheets S, a longer distance may be required between the two sheets S. Therefore, as shown in FIG. 5, when the image is printed on the second side of the sheet S under the print setting of double-face printing, the distance between two sheets S may be longer than a distance between two sheets S under the print setting of single-face printing. The printer 100 may determine the print setting, between double-face printing and single-face printing, based on information contained in the print command.

Meanwhile, under the print setting of heavy paper, the printing pace may be lower than the printing pace under the print setting of regular paper or thinner paper in a reason that heavy paper may have higher heat capacity and may absorb a larger amount of heat than regular paper or thinner paper. Therefore, when the heavy paper is used, the conveying speed to convey the sheet S in the fixing unit 8 may be lowered so that the sheet S may be exposed to the heat for a longer time at the nip in the fixing unit 8, and the toner image may be fixed onto the sheet S thoroughly. The print setting of the heavy paper may be determined based on, for example, information which may be contained in the print command, or information concerning a sheet type associated with the feeder tray designated in the print command.

Under the same print setting, the low-temperature printing pace is lower than or equal to the high-temperature printing pace. Therefore, for example, under the same print setting, the interval between the sheets S may be longer in the low-temperature printing pace than the interval in the high-temperature printing pace. More specifically, a longer time period may be required after a preceding sheet S passes through the registration roller pair 75 and before a succeeding sheet S is forwarded from the registration roller pair 75 in the low-temperature printing pace. Thus, the heat in the fixing unit 8 may recover to a temperature required for image-fixing by the time when the succeeding sheet S reaches the fixing unit 8. Further, while the conveying speed to convey the sheet S in the fixing unit 8 may be slower in the low-temperature printing pace than the high-temperature printing pace under the same print setting, every part of the sheet S may be exposed to the heat for a longer time at the nip in the fixing unit 8, and the toner image may be fixed onto the sheet S thoroughly.

Meanwhile, as shown in FIG. 5, a pace reduction rate, which is a difference between the high-temperature printing pace and the low-temperature printing pace under the same print setting, may vary depending on the print settings. That is, there may be a print setting with higher efficiency and a printing setting with lower efficiency with regard to the high-temperature printing paces. And the pace reduction rate under the print setting with lower efficiency with regard to the high-temperature printing pace may be smaller than the pace reduction rate under the print setting with higher efficiency with regard to the high-temperature printing pace. In other words, between the two print settings, the print setting associated with the higher high-temperature printing pace may have a larger pace reduction rate than the pace reduction rate of the print setting associated with the lower high-temperature printing pace. This is because, under the print setting, of which high-temperature printing pace is lower compared to the other print setting, it may be likely that the image-fixing quality may be maintained even if the printing pace is not lowered largely when in the low-temperature ambience. In this regard, the pace reduction rate may be a difference between absolute values of the intervals or the conveying speeds or may be a ratio between the high-temperature printing paces.

More specifically, for example, under the print setting of single-face printing, the distance between two sheets S may be smaller than a distance between two sheets S under the print setting of double-face printing for the second side (in either ambient temperature). In other words, the printing pace (efficiency) may be higher under the print setting of single-face printing than the double-face printing for the second side. In this regard, as shown in FIG. 5, under the print setting of single-face printing, the difference (e.g., 2) between the high-temperature printing pace (e.g., 10) and the low-temperature printing pace (e.g., 12) may be larger than the difference (e.g., 0) between the high-temperature printing pace (e.g., 14) and the low-temperature printing pace (e.g., 14) under the print setting of double-face printing for the second side. For another example, under the print setting of regular paper, the conveying speed to convey the sheet S may be faster than the conveying speed under the print setting of heavy paper. In other words, the efficiency under the print setting of regular paper may be higher than the efficiency under the print setting of heavy paper. Therefore, under the print setting of regular paper, the difference (e.g., 2) between the higher-temperature pace (e.g., 10) and the lower-temperature pace (e.g., 8) may be larger than the difference (e.g., 1) between the high-temperature printing pace (e.g., 8) and the low-temperature printing pace (e.g., 7) under the print setting of heavy paper. Thus, by altering pace reduction rates among the print settings, printing efficiency or printing productivity may be restrained from being lowered, while the image-fixing quality may be maintained.

Meanwhile, even if the printer 100 determines when the print job is entered that the ambient temperature is low and applies the low-temperature printing pace, the temperature in the fixing unit 8 may be increased as the printing operation continues. In such a case, the image-fixing quality may be maintained even if the printing pace is increased. Therefore, while the printing operation is conducted in the low-temperature printing pace, the printer 100 may increase the printing pace when the printer 100 determines that the temperature in the fixing unit 8 is higher than a predetermined threshold. Thereby, the printing efficiency may be increased. In this regard, an upper limit to increase the printing pace may be at the high-temperature printing pace within the same print setting. In other words, the printing pace may be increased up to the high-temperature printing pace or to a certain printing pace between the high-temperature printing pace and the low-temperature printing pace. In this regard, the predetermined threshold may be a temperature lower than the shutoff temperature for the thermostat 65.

Figure 6:
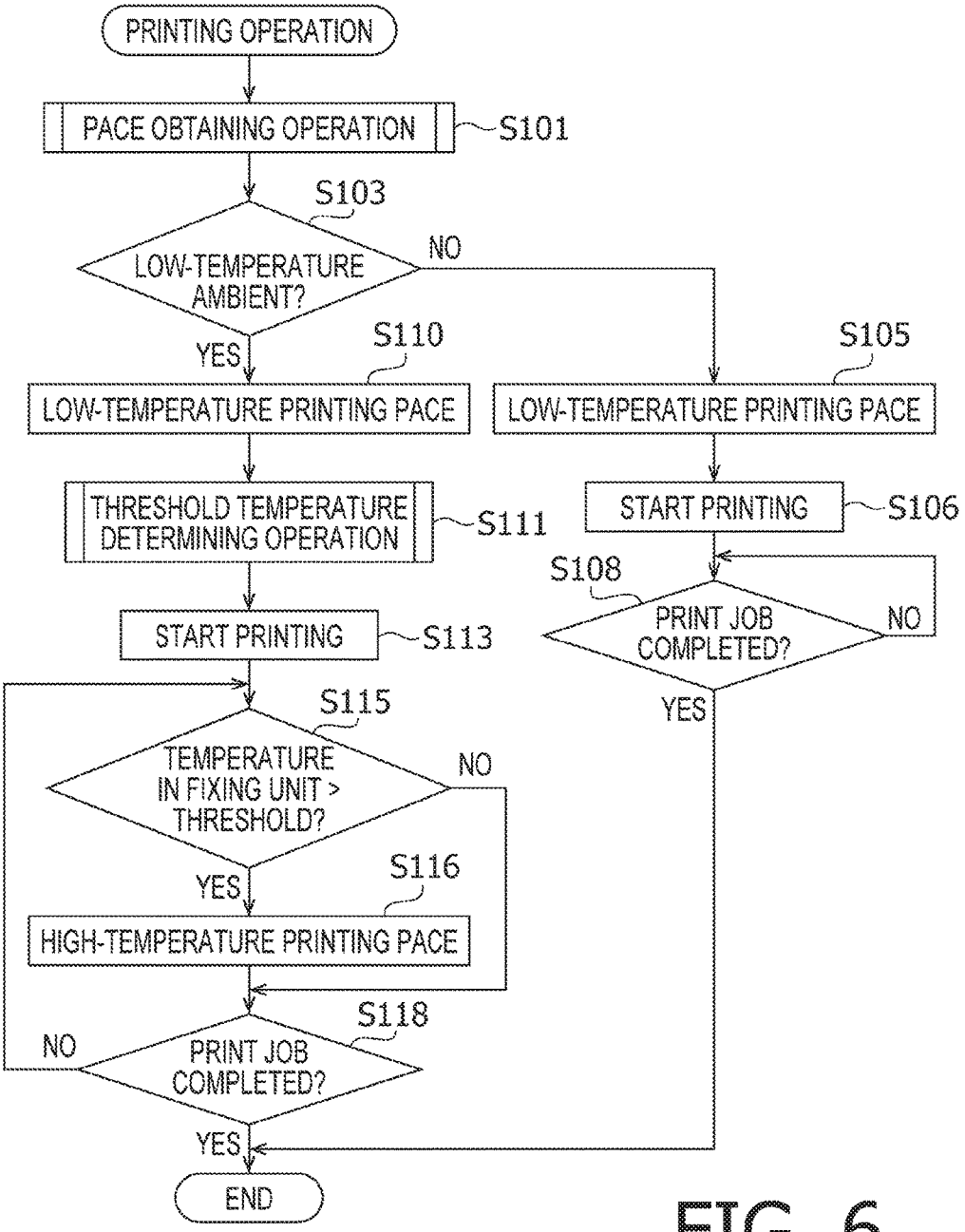
FIG. 6 is a flowchart to illustrate a first example of a flow of steps in a printing operation to be performed by the controller in the printer according to the embodiment of the present disclosure.

Next, a first example of a flow of steps to be performed by the printer 100 in the printing operation will be described with reference to FIG. 6. More specifically, the printing operation may be executed by the CPU 31 in response to receipt of the print command entered by the user.

When the flow starts, in S101, the printer 100 executes a pace obtaining operation to obtain a printing pace. In the pace obtaining operation in S101, the printer 100 obtains a high-temperature printing pace and a low-temperature printing pace for a print setting designated in the print command.

Figure 7:
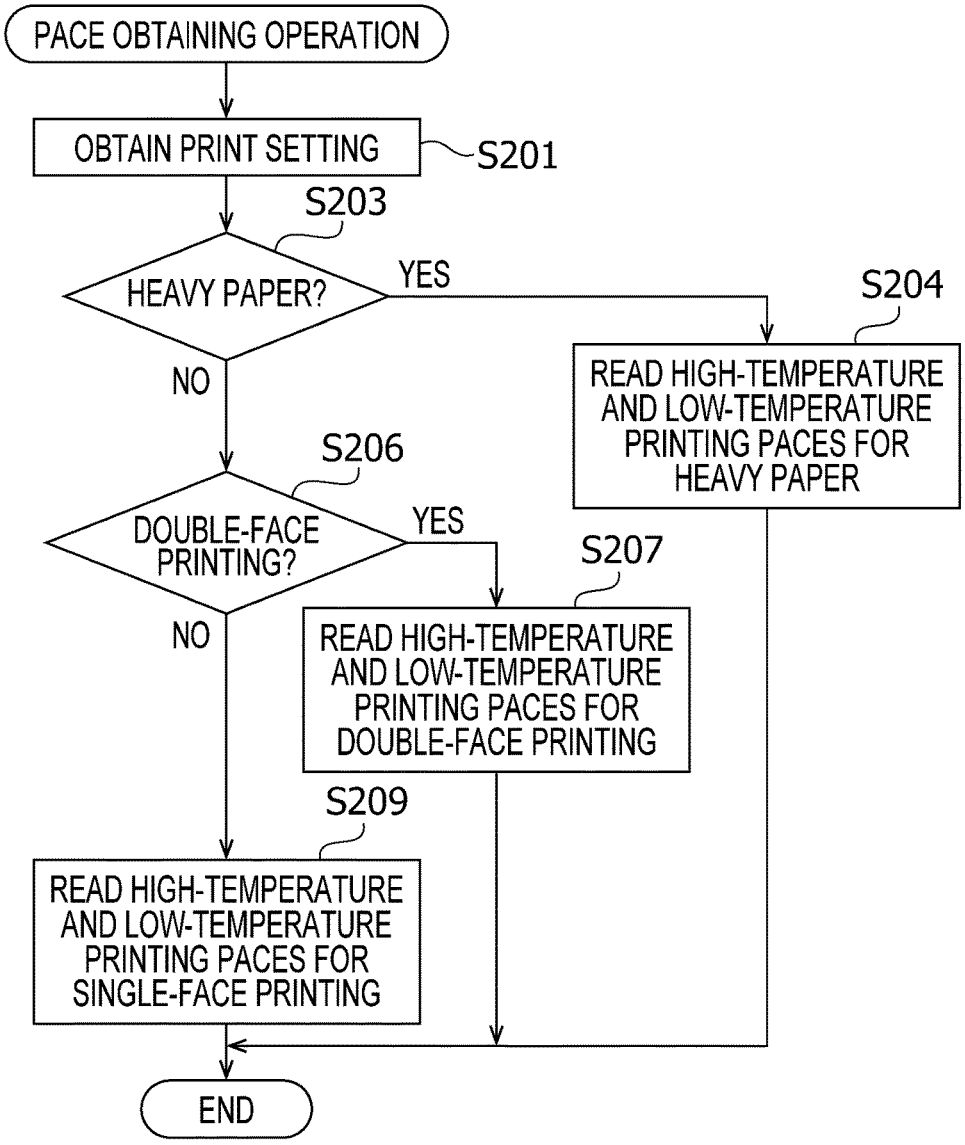
FIG. 7 is a flowchart to illustrate a flow of steps in a printing pace obtaining operation to be performed by the controller in the printer according to the embodiment of the present disclosure.

The pace obtaining operation will be described with reference to FIG. 7. As the flow starts, in S201, the printer 100 obtains a print setting based on the print command. The printer 100 may obtain, for example, a print setting of single-face printing or double-face printing, and/or a type of the sheet S to be used in the printing operation.

In S203, the printer 100 refers to the printing pace table 321 and reads a printing pace associated with the obtained print setting. More specifically, in S203, the printer determines whether the print command indicates a printing operation with a heavy paper. If the print command designates heavy paper (S203: YES), in S204, the printer 100 refers to the printing pace table 321 and reads the high-temperature printing pace and the low-temperature printing pace associated with the print setting of heavy paper. The pace obtaining operation ends thereat.

Meanwhile, in S203, if the print command does not designate heavy paper (S203: NO), in S206, the printer 100 determines whether the print command designates double-face printing. If the printer 100 determines that the print command designates double-face printing (S206: YES), in S207, the printer 100 refers to the printing pace table 321 and reads the high-temperature printing pace and the low-temperature printing pace associated with the print setting of double-face printing. The pace obtaining operation ends thereat.

In S206, if the print command does not designate double-face printing (S206: NO), in S209, the printer 100 refers to the printing pace table 321 and reads the high-temperature printing pace and the low-temperature printing pace associated with the print setting of single-face printing. The pace obtaining operation ends thereat. Meanwhile, if the print job contains a printing operation for a plurality of sheets S with different print settings, the printer may first obtain the printing pace for a first sheet according to a designated print setting associated with the first sheet. The flow returns to S101 in the printing operation (see FIG. 6).

Referring back to FIG. 6, following the pace obtaining operation in S101, in S103, the printer 100 determines if the ambient temperature is low. For example, the printer 100 may estimate a temperature in the exterior ambience based on the output signals from the exterior thermistor 61. If the estimated temperature is lower than a predetermined temperature, the printer 100 may determine that the ambient temperature is low. If the estimated temperature is not lower than the predetermined temperature, the printer 100 may determine that the ambient temperature is high.

In S103, if the ambient temperature is not low (S103: NO), in S105, the printer determines that the high-temperature printing pace is to be applied. In S106, the printer 100 conducts the printing operation at the high-temperature printing pace. The printing operation may include conveyance of the sheet S.

In S108, the printer 100 determines if the print job by the print command is completed. If the print job is not completed (S108: NO), the printer 100 repeats S108 and continues the printing operation. When the print job is completed (S108: YES), the printer 100 ends the printing operation.

Meanwhile, in S103, if the ambient temperature is low (S103: YES), in S110, the printer 100 determines that the low-temperature printing pace is to be applied. In this regard, for example, if the designated print setting is single-face printing or double-face printing, in the low-temperature printing pace, the distance between the sheets S is enlarged to be larger than the distance between the sheets S in the high-temperature printing pace under the same print setting. For another example, if the designated print setting is regular paper or heavy paper, in the low-temperature printing pace, the conveying speed to convey the sheet S is lowered to be slower than the conveying speed in the high-temperature printing pace under the same print setting.

Following S110, in S111, the printer executes a threshold temperature determining operation. In the threshold temperature determining operation, a threshold temperature for the fixing unit 8, by which necessity of increasing the printing pace is judged, is determined.

Figure 8:
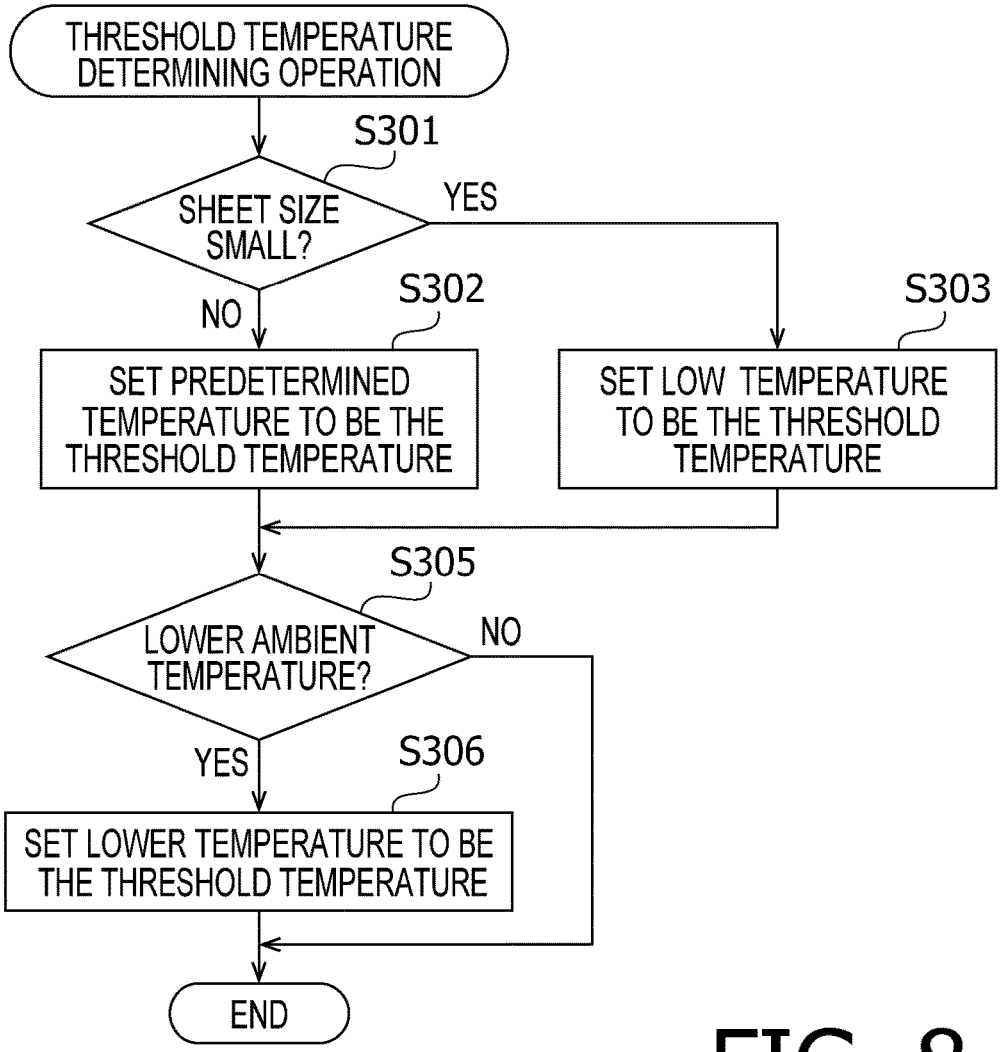
FIG. 8 is a flowchart to illustrate a flow of steps in a threshold-temperature determining operation to be performed by the controller in the printer according to the embodiment of the present disclosure.

A flow of steps in the threshold temperature determining operation will be described with reference to FIG. 8. In S301, the printer 100 determines whether a size of a previously printed sheet S is a small size smaller than a predetermined size. In this regard, as mentioned above, and as shown in FIG. 3, the sizes of the sheets S usable in the printer 100 with regard to the axial direction of the heat roller 81 are limited. If the size of the previously printed sheet S is smaller than an intermediate size between the maximum usable size Wmax and the minimum usable size Wmin, the printer 100 may determine that the size of the sheet S is small. In this regard, the printer may determine that the size of the sheet S is small with regard to a size of the sheet S along the conveying direction to convey the sheet S, additionally to the size of the sheet S in the axial direction of the heat roller 81.

In S301, if the size of the previously printed sheet S is determined not to be small (S301: NO), in S302, the printer 100 sets a predetermined value to be the threshold temperature for the fixing unit 8. Meanwhile, if the size of the previously printed sheet S is determined to be small (S301: YES), in S303, the printer 100 modifies the threshold temperature for the fixing unit 8. In particular, the printer 100 sets a lower value, which is smaller than the predetermined value, to be the threshold temperature for the fixing unit 8.

In S305, the printer 100 determines whether the ambient temperature obtained in S103 (FIG. 6) is lower, which is particularly lower, for a predetermined degree, than the predetermined temperature. If the ambient temperature is determined to be lower (S305: YES), in S306, the printer 100 sets a lower value, which is lower than the threshold temperature determined in S302 or S303, to be the threshold temperature depending on the ambient temperature. The threshold temperature determining operation ends thereat. Meanwhile, in S305, if the ambient temperature is determined not to be particularly lower than the predetermined temperature (S305: NO), the printer 100 skips S304 and maintains the threshold determined in S302 or S303. The threshold temperature determining operation ends thereat. The flow returns to S111 (see FIG. 6).

Referring back to FIG. 6, following S111, in S113, the printer 100 conducts the printing operation at the low-temperature printing pace determined in S110. The printing operation in S113 may include conveyance of the sheet S.

In S115, the printer 100 determines whether the temperature in the fixing unit 8 is higher than the threshold temperature determined in the threshold temperature determining operation in S111. In this regard, for example, the printer 100 may estimate a temperature on the surface of the heat roller 81 based on the output signals from the side thermistor 64 and compare the estimated temperature with the threshold temperature. While the detectable area for the side thermistor 64 is outside the pathway range for the sheet S with regard to the axial direction of the heat roller 81, the temperature in the detectable area may tend not to be changed rapidly by the sheet S passing thereby. In other words, the determination in S115 may be made rather easily.

In S115, if the printer 100 determines that the temperature in the fixing unit 8 is higher than the threshold temperature (S115: YES), in S116, the printer 100 applies the high-temperature printing pace. Meanwhile, in S115, if the printer 100 determines that the temperature in the fixing unit 8 is not higher than the threshold temperature (S115: NO), the printer 100 skips S116 and in S118 determines if the print job is completed.

If the print job is not completed (S118: NO), the printer 100 continues the printing operation and in S115 monitors the temperature in the fixing unit 8. In this regard, a plurality of threshold temperatures may be prepared in advance, and the printing pace may be increased within a range between the low-temperature printing pace and the high-temperature printing pace gradually. When the print job is completed (S118: YES), the printing operation is ended.

With the printer 100 according to the first exemplary flow described above, when the ambient temperature is low, the printing pace is lowered than the printing pace in the high-temperature ambience so that the image fixing quality may be maintained. The reduction rate of the of the printing pace may be smaller under the printing setting associated with the lower printing efficiency than the reduction rate under the printing setting associated with the higher printing efficiency. Therefore, while the printing productivity may not necessarily be lowered, the heat required for image-fixing may be maintained.

Figure 9:
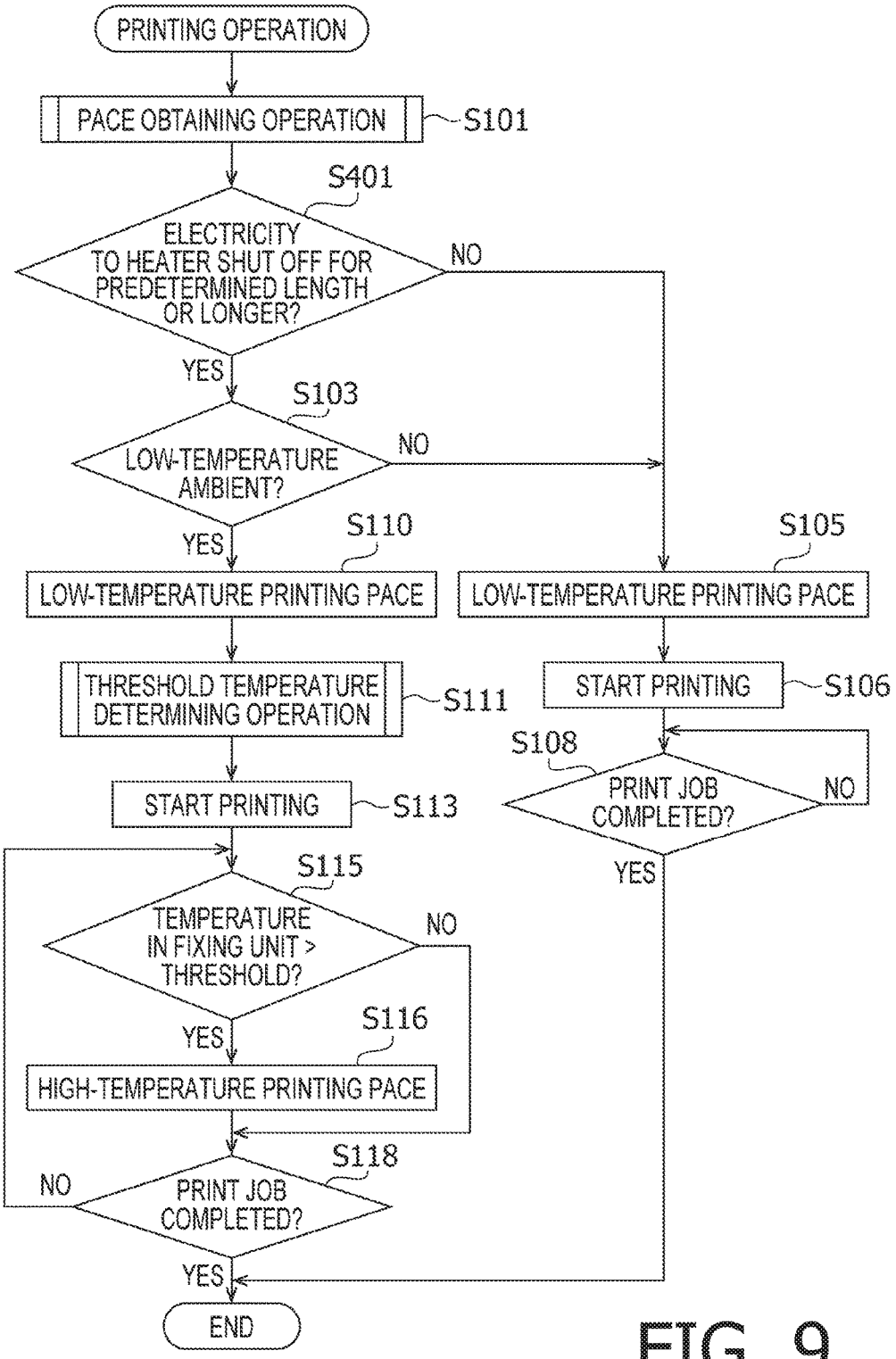
FIG. 9 is a flow chart to illustrate is a second example of a flow of steps in the printing operation to be performed by the controller in the printer according to the embodiment of the present disclosure.

Next, a second example of the flow of steps to be performed by the printer 100 in the printing operation will be described with reference to FIG. 9. The second example is different from the first example in that the high-temperature printing pace is applied regardless of the ambient temperature if a time period after shutoff of the electricity to the heater 83 in the fixing unit 8 is short. In the following description, items or structures which are the same as or similar to the items or the structures described in the previous example will be referred to by the same reference signs, and description of those will be omitted.

In the printing operation in the second example, following the pace obtaining operation in S101, in S401, the printer 100 determines if the electricity to the heater 83 has been shut off for a predetermined length of period or longer. In the second example, the printer 100 may shut off the electricity to the heater 83 in the fixing unit 8 if the printer 100 is left unused, for example, without entry of any command, for a predetermined length of period after completion of a print job in order to, for example, reduce consumption of electricity.

In S401, if the printer 100 determines that the electricity to the heater 83 has not been shut off for the predetermined length of period or longer (S401: NO), in S105, the printer 100 applies the high-temperature printing pace regardless of the ambient temperature. This is because, if it is within the predetermined length of period after the electricity to the heater 83 is shut off, it may be likely that the temperature in the heat roller 81 may be substantially high. Alternately, in S401, the printer 100 may determine to apply the high-temperature printing pace regardless of the ambient temperature based on a temperature in the heat roller 81 estimated from the signals from, for example, the side thermistor 64 instead of determining based on the length of shutoff period of the electricity to the heater 83.

In S401, if the printer 100 determines that the electricity to the heater 83 has been shut off for the predetermined length of period or longer (S401: YES), in S103, the printer 100 determines if the ambient temperature is low. The steps following S103 may be performed similarly to the flow of the printing operation in the first example.

In the second example of the printing operation, in the threshold temperature determining operation in S301 (see FIG. 8), when the printer 100 determines a size of the sheet S, it is a size of a sheet S to be printed currently rather than a size of the previously printed sheet S. Therefore, in S301, if the size of the current sheet S to be printed is determined to be small (S301: YES), the printer 100 may set a lower value which is smaller than the predetermined value to be the threshold temperature in S303. On the other hand, if the size of the current sheet S to be printed is determined not to be small (S301: NO), the printer 100 may set a predetermined value to be the threshold temperature. A reference size to determine the small size for the sheet S may be either the same as or different from the reference size in the first example.

Thus, according to the printer 100 in the second example, the heat required in the fixing unit 8 for image-fixing may be maintained while reduction of the printing productivity may be restrained. Further, according to the second example, the printer 100 may not obtain the ambient temperature when the temperature in the fixing unit 8 is likely to be maintained. Therefore, reduction of the printing efficiency may be restrained in the less complicated flow. Meanwhile, according to the first example, the printing pace may be determined depending on the ambient temperature regardless of the condition in the fixing unit 8; therefore, the image-fixing quality may be maintained more securely.

Although examples of carrying out the disclosure have been described, those skilled in the art will appreciate that there are numerous variations and permutations of the image forming apparatus, the method and the program to control the image forming program that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

For example, the embodiments described above may not necessarily be applied to a printer but may be applied to other apparatuses having an image forming function, such as a copier and a facsimile machine. Further, the image forming function may not necessarily be a function to form multi-colored images but may be a monochrome image-forming function. For another example, the heat roller 81 may be replaced with a belt that may heat the sheet S with a toner image.

For another example, the print settings to be set in the printer 100 may not necessarily be limited to those described above (e.g., single/double-face printing and sheet types). For example, the print setting may be either one of the single/double-face printing or the sheet type or may include other print settings. For example, the sheet type may not necessarily be limited to the regular paper and the heavy paper. For another example, the print settings may be differed depending on a size of the sheet S to be used in the printing operation.

For another example, the low-temperature printing pace may not necessarily be prepared in advance but may be obtained each time by, for example, subtracting a predetermined value from the high-temperature printing pace or multiplying a predetermined value to the high-temperature printing pace. In such configuration, the predetermined value to be applied to the high-temperature printing pace may be prepared in advance. For another example, the printing pace may not necessarily be determined between the two phases but may be determined among a plurality of printing paces, which may be prepared for various ambient temperatures.

For another example, the determination of the low temperature in S103 (FIG. 6) may not necessarily depend on the output signals from the exterior thermistor 61 but may depend on signals output from the central thermistor 63 and from the side thermistor 64. In a low-temperature ambience, the temperature in the sheet S may be lower, and the temperature in the heat roller 81 may be largely decreased in the pathway range where the sheet S passes through. After the sheet S in the lower temperature passes through, the temperature in the heat roller 81 may be lowered largely in the pathway range compared to the other range where the sheet S did not pass through. Therefore, the temperature in the detectable area for the central thermistor 63 and the temperature in the detectable area for the side thermistor 64 may differ largely. Further, when the heat roller 81 is warmed up immediately after the printer 100 is powered on, the temperature in the heat roller 81 may be as low as the ambient temperature. In this regard, the side thermistor 64 being in contact with the surface of the heat roller 81 may detect increase of the temperature earlier than the central thermistor 63, which is not in contact with the surface of the heat roller 81. Therefore, the printer 100 may determine the ambient temperature being low based on the temperature difference between the temperature detected by the central thermistor 63 and the temperature detected by the side thermistor 64.

For another example, the printer 100 may determine the ambient temperature being low based on estimated temperatures, which may be estimated from, for example, seasonal factors and timings within a day. For example, in an early morning or at night in winter, it may be determined that the ambient temperature is low. For another example, in a daytime in summer, it may be determined that the ambient temperature is not low.

For another example, the printing pace may not necessarily be increased after the low-temperature printing pace is applied and when the temperature in the fixing unit 8 increased to be higher than the threshold temperature. For example, in midcourse of a print job, the printing pace may not necessarily be changed but may be maintained. For another example, the printing pace may be increased regardless of the temperature in the fixing unit 8 after images are printed on a predetermined quantity of sheets S. For another example, the threshold temperature may not necessarily be varied depending on the size of the sheet S or the ambient temperature but may be fixed.

For another example, the threshold temperature determining operation in S111 (FIGS. 6, 9) may not necessarily be performed at each print job but may be performed for a plurality of times in a single print job when the print job contains image printing on a plurality of sheets S. In such a case, the size of the sheet S to be determined in S301 (FIG. 8) may be either the size of the sheet S previously printed or the size of the sheet S printed in a previous print job.

For another example, the pace reduction rate between the high-temperature printing pace and the low-temperature printing pace may not necessarily be varied between the print settings based on the highness of the high-temperature printing paces, but the printing pace may be reduced from the high-temperature printing paces for a fixed amount or at a fixed rate regardless of the highness of the high-temperature printing paces. For example, a single printing pace may be prepared for each print setting, and when the ambient temperature is low, the printing pace may be reduced at a uniform rate from the prepared single printing pace. More specifically, the printing pace table 321 (FIG. 5) may contain a single high-temperature printing pace for each print setting, and in S204, S207, and S209 (FIG. 7), the printer 100 may read the prepared single high-temperature printing pace from the printing pace table 321. Thereafter, in S110 (FIGS. 6, 9), a low-temperature printing pace may be calculated from the high-temperature printing pace according to predetermined calculation. Thus, while monitoring the temperature in the fixing unit 8 after the reduction of printing pace, when the temperature in the fixing unit 8 is determined to be higher than the threshold temperature, the printing pace may be increased so that the printing productivity may be restrained from being lowered, while the image-fixing quality may be maintained.

The processes and operations in the embodiments described above may be executed by a single CPU, a plurality of CPUs, a hardware device such as the ASIC, or combination of these devices. Further, the processes and the operations may be accomplished by the programs which may be stored in a recording medium or recorded in other one or more recording methods.

What is claimed is:

1. An image forming apparatus, comprising:

an image forming unit configured to form an image on a sheet;

a fixing unit configured to thermally fix the image on the sheet;

a temperature sensor; and a controller configured to control the image forming unit and the fixing unit to execute a printing operation to print the image on the sheet at one of a plurality of printing paces, wherein the controller is configured to execute the printing operation at:

a first high-temperature printing pace when a first print setting is applied and when a temperature detected by the temperature sensor is higher than a first threshold value;

a first low-temperature printing pace when the first print setting is applied and when the temperature detected by the temperature sensor is one of lower and equal to the first threshold value;

a second high-temperature printing pace when a second print setting is applied and when the temperature detected by the temperature sensor is higher than a second threshold value; and a second low-temperature printing pace when the second print setting is applied and when the temperature detected by the temperature sensor is one of lower and equal to the second threshold value, wherein the first low-temperature printing pace is one of lower than and equal to the first high-temperature printing pace, wherein the second low-temperature printing pace is one of lower than and equal to the second high-temperature printing pace, wherein an absolute difference between the second high-temperature printing pace and the second low-temperature printing pace is greater than an absolute difference between the first high-temperature printing pace and the first low-temperature printing pace, wherein the fixing unit comprises a heat-conductive rotating body, a heater configured to heat the heat-conductive rotating body, and a side temperature sensor configured to detect a temperature at an end area of the heat-conducting rotating body, wherein the controller increases the printing pace of the printing operation when the second low-temperature printing pace is applied and when a temperature detected by the side temperature sensor is higher than a third threshold value, wherein the controller is configured to execute a size determining step, in which whether a size of a sheet conveyed to the image forming unit is a smaller size smaller than a predetermined size is determined, and wherein the controller modifies the third threshold value when the size of the sheet conveyed to the image forming unit is determined to be the smaller size in the size determining step.

2. The image forming apparatus according to claim 1, wherein the second threshold value is equal to the first threshold value.

3. The image forming apparatus according to claim 1, wherein the first print setting designates double-face printing, in which the image is printed on each side of the sheet, and wherein the second print setting designates a single-face printing, in which the image is printed on one side of the sheet.

4. The image forming apparatus according to claim 1, wherein the first print setting designates printing on a first-typed sheet, and wherein the second print setting designates printing on a second-typed sheet, of which thickness is smaller than a thickness of the first-typed sheet.

5. The image forming apparatus according to claim 1, wherein the controller increases the third threshold value when the controller determines that the image forming apparatus is in a low-temperature ambience based on the temperature detected by the temperature sensor.

6. The image forming apparatus according to claim 1, wherein the temperature sensor is disposed outside the fixing unit.

7. The image forming apparatus according to claim 1, wherein the temperature sensor is disposed inside the fixing unit.

8. The image forming apparatus according to claim 1, wherein the plurality of printing paces are defined by an interval between a preceding sheet and a succeeding sheet which are conveyed sequentially.

9. The image forming apparatus according to claim 1, wherein the plurality of printing paces are defined by a conveying speed to convey the sheet in the image forming unit.

* * * * *